US006626267B2

(12) United States Patent
Beus et al.

(10) Patent No.: US 6,626,267 B2
(45) Date of Patent: Sep. 30, 2003

(54) APPARATUS AND METHOD FOR GENERATING POWER ONBOARD A HOIST CONVEYANCE

(75) Inventors: Michael J. Beus, Spokane, WA (US); Carl Sunderman, Spokane, WA (US); Richard Rains, Spokane, WA (US)

(73) Assignee: The United States of America as represented by the Department of Health and Human Services, Washington, DC (US)

( * ) Notice: Subject to any disclaimer, the term of this patent is extended or adjusted under 35 U.S.C. 154(b) by 0 days.

(21) Appl. No.: 10/123,968

(22) Filed: Apr. 16, 2002

(65) Prior Publication Data

US 2002/0157904 A1 Oct. 31, 2002

Related U.S. Application Data

(60) Provisional application No. 60/287,688, filed on Apr. 30, 2001.

(51) Int. Cl.[7] ..... B66B 1/06

(52) U.S. Cl. ..... 187/290; 187/413

(58) Field of Search ..... 187/290, 288, 187/289, 413; 307/64, 65, 66, 67, 68; 320/101, 102, 140

(56) References Cited

U.S. PATENT DOCUMENTS

| | | | | | |
|---|---|---|---|---|---|
| 4,456,097 | A | | 6/1984 | Salihi | |
| 5,317,303 | A | * | 5/1994 | Ross et al. | 340/539 |
| 5,341,902 | A | | 8/1994 | Ruiz, Sr. et al. | |
| 5,368,131 | A | * | 11/1994 | Yoshihiro | 187/301 |
| 5,464,072 | A | * | 11/1995 | Muller | 187/249 |
| 5,728,953 | A | | 3/1998 | Beus et al. | |
| 5,732,795 | A | | 3/1998 | McCarthy et al. | |
| 6,326,765 | B1 | * | 12/2001 | Hughes et al. | 320/104 |
| 6,382,361 | B2 | * | 5/2002 | Nihei et al. | 187/289 |
| 2001/0008191 | A1 | * | 7/2001 | Smith et al. | 180/65.3 |

FOREIGN PATENT DOCUMENTS

| | | | | | |
|---|---|---|---|---|---|
| JP | 09118223 | A | * | 5/1997 | B61B/11/00 |
| JP | 11055864 | A | * | 2/1999 | H02J/7/00 |
| JP | 2001054269 | A | * | 2/2001 | H02K/21/24 |
| JP | 2002031034 | A | * | 1/2002 | F03G/3/00 |
| JP | 2002032192 | A | * | 1/2002 | G06F/3/033 |
| JP | 2002179353 | A | * | 6/2002 | B66B/5/24 |

OTHER PUBLICATIONS

Beus, M.J., "Shaft Conveyance Monitoring as a Safety Maintenance Tool," 7 pages, Presented at the 11$^{th}$ Maintenance/Engineering Operators' Conference, May, 2000.

* cited by examiner

*Primary Examiner*—Jonathan Salata
(74) *Attorney, Agent, or Firm*—Klarquist Sparkman LLP

(57) ABSTRACT

An onboard power generation apparatus for a hoist conveyance includes a drive wheel carried by the conveyance. The drive wheel is positioned to engage the surface of a stationary structure adjacent the conveyance, such as a shaft guide, so that movement of the conveyance relative to the structure causes rotation of the drive wheel. A charging generator coupled to the drive wheel is operable to produce an electric current upon rotation of the drive wheel. A battery may be electrically connected to the generator so that the generator provides an electric current to recharge the battery. The drive wheel may be mounted for movement relative to the conveyance with biasing mechanism for resiliently biasing the drive wheel toward the surface of the adjacent structure.

38 Claims, 8 Drawing Sheets

APPARATUS AND METHOD FOR GENERATING POWER ONBOARD A HOIST CONVEYANCE

CROSS-REFERENCE TO RELATED APPLICATION

This application claims priority to U.S. Provisional Application No. 60/287,688, filed Apr. 30, 2001.

FIELD

The present invention relates to a power generator and more specifically to an onboard power generator for supplying power to a hoist conveyance, such as a mine shaft elevator or an above-ground elevator.

BACKGROUND AND SUMMARY

The mine shaft is the lifeline to underground mining operations. Although there are relatively few injuries and fatalities related to shaft accidents, almost any accident involving hoisting equipment, and in particular a hoist conveyance, has the potential to be catastrophic and injure or kill numerous miners. Between 1992 and 1996, there were approximately 1200 reported accidents involving mine shaft operations. Analysis of these accidents shows that hoisting hazards are often related to falling material, shaft guide misalignment and faulty safety devices. In fact, over 300 of the cited accidents were related to shaft guide misalignment caused by ground instability.

To reduce the potential for hoisting related accidents, sensors and other devices are used to monitor conveyance operating parameters (e.g., rope tension, conveyance load and conveyance position). Feedback from the monitoring devices can then be used to address potential problems before a catastrophic accident occurs. Mounting such devices onboard the conveyance itself, such as to the top of the conveyance cage, is desirable in that accurate, real time measurements relating to the operation of the conveyance can be obtained.

When mounting various monitoring devices onboard a conveyance, a reliable source of electrical power is required. It is known that hoist conveyances employ a traveling cable connected between the conveyance and the control room to provide electrical power to the conveyance. In relatively deep mine shafts (e.g., greater than 600 feet deep), however, it is not feasible to employ a traveling cable. In such deep shafts, information must be via radio or other remote means having its own on-board power source. Thus, well-charged batteries onboard the conveyance are a necessity.

The present invention is directed toward an onboard power generation apparatus for a hoist conveyance, such as a mine shaft elevator or an above-ground elevator. In one embodiment of the invention, a drive wheel is carried by the conveyance. The drive wheel is positioned to engage the surface of a stationary structure adjacent the conveyance, such as a shaft guide, so that vertical movement of the conveyance relative to the structure causes rotation of the drive wheel. The drive wheel may include an elastomeric outer tread layer to minimize slip between the drive wheel and the surface of the adjacent structure. A charging generator, which is coupled to the drive wheel, is operable to produce an electric current upon rotation of the drive wheel to provide power to the conveyance.

A battery may be electrically connected to the generator so that the generator provides an electric current to recharge the battery upon movement of the conveyance. The battery may be used to power a voice communication system or any of various onboard conveyance monitoring devices, such as an encoder for determining the vertical position of the conveyance or a potentiometer for determining lateral displacement of the shaft guides or a load cell to determine wire rope tension or an accelerometer (e.g., a two-axis accelerometer) for determining the acceleration of the conveyance.

The apparatus also may include biasing mechanism for resiliently biasing the drive wheel toward the surface of the adjacent structure. In one disclosed embodiment, the drive wheel and the charging generator are mounted on a common support. The support is mounted for movement relative to the conveyance in a direction generally perpendicular to the central axis of the drive wheel and toward the surface of the adjacent structure. At least one spring is operatively connected to the support and to the conveyance to bias the support toward the adjacent structure to maintain contact between the drive wheel and the surface of the structure.

According to another embodiment, a power generation apparatus for supplying power to a vertically movable hoist conveyance comprises a generator carried by the conveyance. The generator includes at least one drive wheel rotatably coupled thereto and operable to contact the surface of an adjacent stationary structure so that movement of the conveyance causes rotation of the drive wheel to generate an electric current. The drive wheel is mounted on a support that is operable to move with respect to the conveyance to accommodate variations in the surface of the adjacent structure as the conveyance moves vertically relative to the structure.

In another embodiment, power generation apparatus is mounted onboard a mine hoist conveyance having guide wheels for engaging shaft guides and onboard instrumentation for monitoring the operation of the conveyance. The apparatus includes a battery for supplying power to at least the instrumentation of the conveyance. A generator is carried by the conveyance and operatively connected to one of the guide wheels of the conveyance to produce an electric current upon movement of the conveyance. The generator is electrically connected to the battery to recharge the battery.

Finally, a method for generating power for a hoist conveyance operable to move vertically through a shaft comprises providing a generator assembly for mounting on the conveyance. The generator has at least one wheel for contacting a substantially stationary surface in the shaft. Thus, an electric current is generated when the wheel rotates upon vertical movement of the conveyance. The method may further include recharging a battery onboard the conveyance with the electric current. In addition, the wheel of the generator assembly may be resiliently biased toward the surface in the shaft to accommodate variations in the surface as the conveyance is moved.

The foregoing and other objects, features, and advantages of the invention will become more apparent from the following detailed description of several embodiments, which proceed with reference to the accompanying figures.

DETAILED DESCRIPTION

Figure 1:
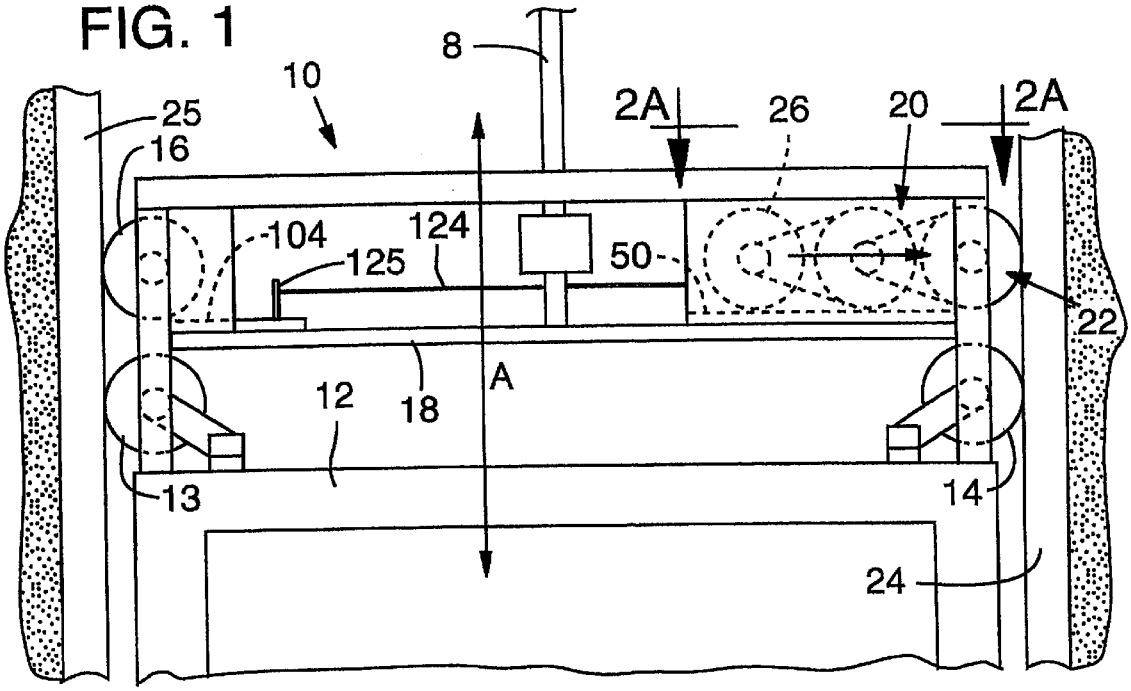
FIG. 1 is a side elevation view of onboard power generation apparatus mounted to the top of a mine shaft conveyance.

Referring first to FIG. 1, there is shown onboard power generation apparatus 20 for providing electrical power to a vertically movable hoist conveyance, such as a mine shaft elevator 10. Apparatus 20 also may be used in connection with other types of hoist conveyances, such as a conventional aboveground elevator. Conveyance 10 is operable to move vertically through a conveyance shaft (as indicated by double-headed arrow A). In this system an elongate cable 8 raises and lowers the conveyance. Vertically disposed stationary shaft guides 24, 25 comprising, for example, 6 inch by 4 inch timber rails, may be secured to opposite sides of the shaft. Guides in the form of rails of other materials, such as steel, also may be used.

Apparatus 20 may be mounted on or carried by conveyance 10 in any suitable manner. In FIG. 1, for example, apparatus 20 is shown mounted on a platform 18 secured to the top of the conveyance 10. Other mounting arrangements also may be used. For example, apparatus 20 may be mounted to the bottom of the conveyance or within the cage 12 of the conveyance.

Apparatus 20 includes a drive wheel 22 positioned to engage the surface of a stationary structure adjacent the conveyance, such as shaft guide 24 in the illustrated example, so that vertical movement of the conveyance relative to the structure causes rotation of drive wheel 22. The form of the adjacent structure will of course depend upon the particular application in which the apparatus 20 is used. For example, the drive wheel may be positioned to directly engage the surface of the shaft through which the conveyance moves if shaft guides are not provided.

Figure 2A:
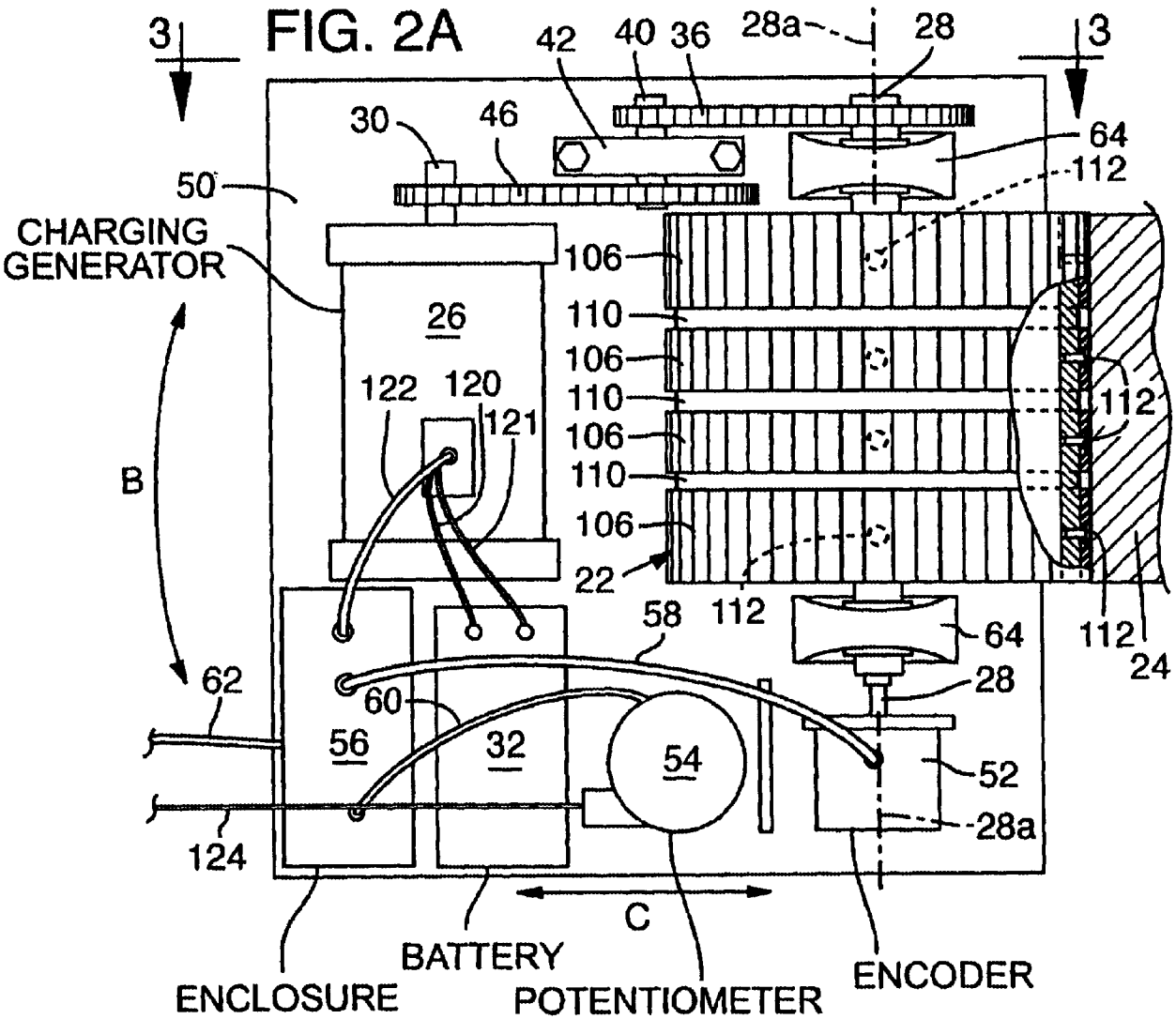
FIG. 2A is a top plan view of the onboard power generation apparatus of FIG. 1 taken along line 2A—2A, with an enclosing top cover removed.

The drive wheel 22, in the form shown, is coupled to a charging generator 26 that is operable to produce an electric current upon rotation of the drive wheel. As best shown in FIG. 2A, the shaft 28 of the drive wheel 22 is supported at each end by bearings 64 mounted on a substantially horizontally disposed plate support 50. The rotational axis 28*a* for shaft 28 and wheel 22 is disposed substantially horizontally. The generator 26 also may be mounted on the support 50.

As explained in greater detail below, support 50 may be mounted on the conveyance for longitudinal movement relative to the conveyance in a direction generally perpendicular to shaft guide 24 and to axis 28*a* (such movement is indicated by double-headed arrow C in FIGS. 2A, 3A). In addition, biasing mechanism may be provided to resiliently, or yieldably, bias support 50, and therefore drive wheel 22, toward shaft guide 24.

An optional tracking, or guide, wheel 16 can be mounted on platform 18 opposite drive wheel 22 and positioned to engage adjacent shaft guide 25 (FIG. 1). As best shown in FIG. 3B, guide wheel 16 also may be mounted on a movable support 104 for longitudinal movement relative to the conveyance in a direction generally perpendicular to the shaft guide 25 and perpendicular to central axis 16*a* for guide wheel 16 (as shown by double-headed arrow D). As with drive wheel 22, a biasing mechanism resiliently, or yieldably, biases support 104 and the guide wheel 16 toward shaft guide 25. In addition, conveyance 10 may include a pair of conventional guide wheels 13 and 14 mounted on opposite sides of the top of the cage 12 for engaging shaft guides 25 and 24, respectively (FIG. 1). Guide wheels 13 and 14 may be spring loaded to be urged against their shaft guides as is well known in the art.

The charging generator 26 desirably is configured to provide a charging current to the battery 32. As shown in FIG. 2A, for example, the charging generator 26 is electrically connected via two conductors of a four-conductor wire 122 to input terminals on a first circuit board (not shown) contained in an enclosure 56. The first circuit board includes an appropriate charging control circuit to receive current from the generator 26. The first circuit board may be mounted on a heatsink (not shown) to dissipate thermal energy from the charging circuit. The other two conductors of four-conductor wire 122 are electrically connected to terminals on the first circuit board and to leads 120, 121 of a battery 32 so that the battery receives a charging current from the generator 26 through the charging circuit. The charging circuit increases the voltage of the charging current going to the battery 32 and permits recharging of the battery upon vertical movement of the conveyance.

The charging generator 26 can be used to provide electric power to any of various devices onboard the conveyance. In the illustrated embodiment, for example, an encoder 52 is electrically connected to the first circuit board with a multiple conductor wire 58. An optional potentiometer 54 is electrically connected to the first circuit board with a multiple conductor wire 60. A multiple conductor wire 62 electrically connects the first circuit board to other instrumentation (not shown) (e.g., an accelerometer for determining the acceleration of the conveyance) and a second circuit board (not shown) onboard the conveyance. Upon rotation of drive wheel 22, the generator 26 provides current through the charging circuit of the first circuit board to battery 32 and multiple conductor wire 62. The second circuit board in turn sends a current back to the first circuit board via multiple conductor wire 62 to power the encoder 52 and potentiometer 54. When the drive wheel 22 is at rest, the battery 32 provides current to the encoder 52, potentiometer 54 and multiple conductor wire 62 through the circuit board. In addition to the encoder and potentiometer in the illustrated embodiment, the generator 26 and/or battery 32 could be used to power other devices, such as the doors, lighting, fan, control panel, and communication devices (e.g., an emergency phone) of a conveyance.

Figure 6:
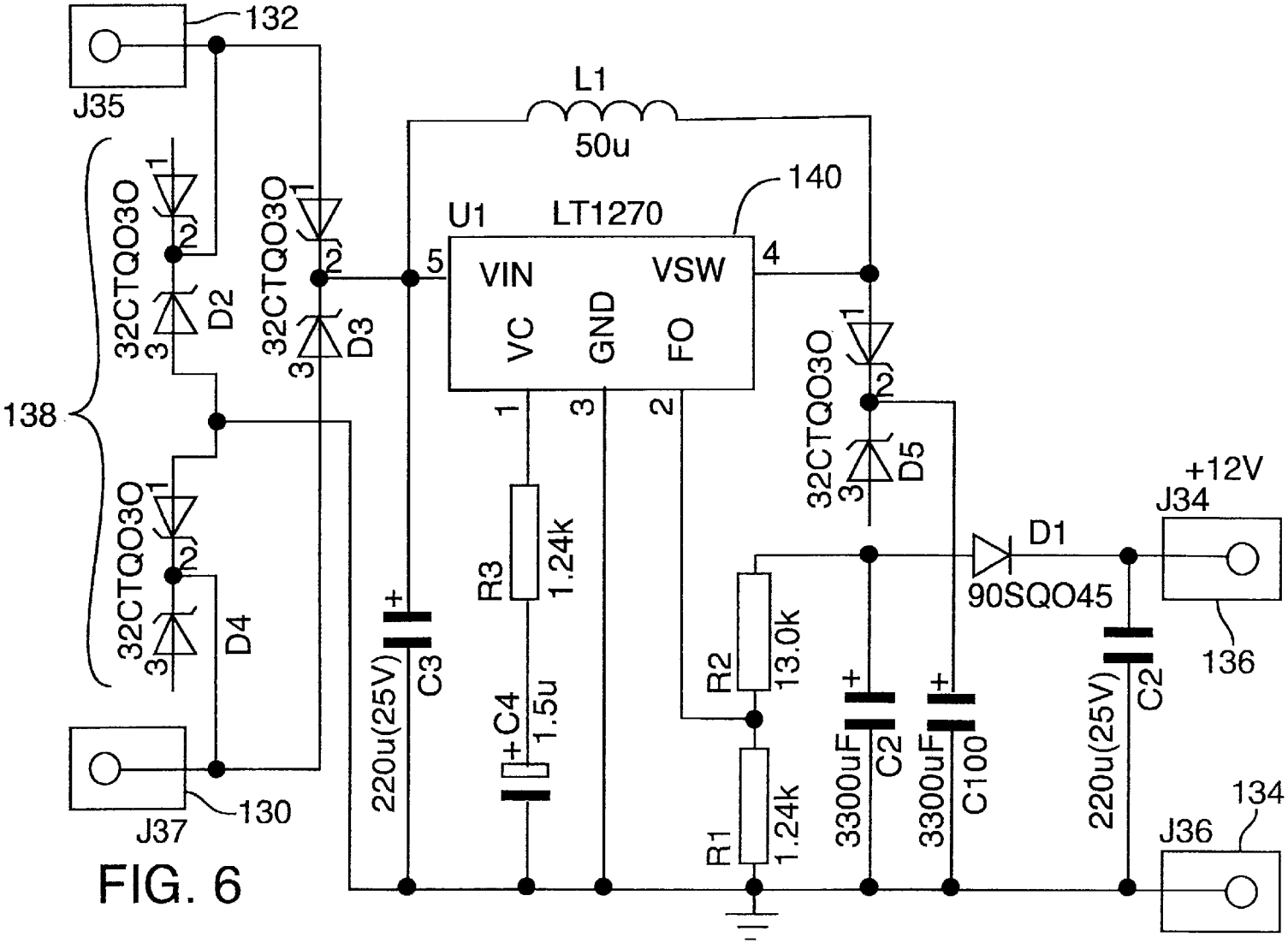
FIG. 6 is a schematic diagram of an exemplary charging circuit in the apparatus.

An example of a charging circuit which may be used in this apparatus is shown schematically in FIG. 6. Input contacts 130, 132 connect to generator 26 and output contacts 134, 136 provide current to battery 32 and wire 62. As shown, the charging circuit includes a rectifier 138 for converting the AC current of the generator 26 into a DC current and a regulating switch 140 to enable charging of the battery with upward or downward movement of the conveyance.

As shown in FIG. 2A, the encoder 52, potentiometer 54, battery 32 and enclosure 56 are mounted on the support 50 along with the drive wheel 22 and charging generator 26 to provide a compact package. The encoder 52, which is coupled to one end of the shaft 28 of the drive wheel, is operable to determine the vertical position of the conveyance 10 within the shaft by counting the rotations of the drive wheel 22. Data from the encoder also can be used to compute conveyance speed and acceleration on a remote or onboard computer. Encoder 52 also can be used to determine whether slippage of drive wheel 22 relative to shaft guide 24 is occurring. If necessary, the biasing mechanism can be adjusted, as explained in greater detail below, to increase the biasing force of drive wheel 22 against shaft guide 24 and thereby reduce any slippage.

The potentiometer 54 houses one end of a retractable string 124. The opposite end, or free end, of string 124 is secured to an upright post 125 secured to support 104 for the guide wheel 16. The string potentiometer is operable to monitor any variation in the distance between the resiliently biased drive wheel 22 and guide wheel 16 and thereby indicate lateral displacement of shaft guides 24, 25. By monitoring the displacement of shaft guides 24, 25, it is possible to determine when necessary repairs or maintenance is required so that catastrophic accidents caused by guide displacement can be avoided.

To transfer rotation of drive wheel 22 to rotation of charging generator 26, drive wheel 22 may be operatively coupled to the charging generator 26 through any suitable transmission mechanism. In the illustrated embodiment, for example, as best shown in FIG. 3A, a drive chain 36 passes about a drive sprocket 34 mounted on the output shaft 28 of drive wheel 22 and an intermediate driven sprocket 38. The driven sprocket 38 is mounted on a shaft 40 supported by a bearing 42 that is mounted on support 50 (see FIGS. 2A, 3A). An intermediate drive sprocket 44 also is mounted on shaft 40. A second drive chain 46 is trained about drive sprocket 44 and a driven sprocket 48 mounted on the input shaft 30 of the charging generator 26. Thus, it can be seen that rotation of the drive wheel 22 causes rotation of the charging generator 26.

Other forms of transmission mechanisms also may be used. For example, the drive sprocket 34 of the drive wheel 22 may be operatively connected to the driven sprocket 48 of the generator without intermediate sprockets 38 and 44. Alternatively, the drive chains and sprockets could be replaced with belts and pulleys, respectively. In another embodiment, the shaft 28 of the drive wheel 22 may be coupled to the shaft 30 of the generator 26 through a gearbox. The shafts of the drive wheel and generator also could be directly coupled to each other with a shaft coupling. The drive wheel and the generator also could be formed as an integral unit, wherein the drive wheel and generator are mounted on a common shaft, or wherein the drive wheel itself contains windings to generate an electric current.

In addition, the transmission mechanism may be selected to maintain a suitable balance between the charging requirement of the battery and the load induced by the charging generator on the drive wheel for a particular conveyance speed. This ensures that sufficient current is generated to recharge the battery while minimizing rolling resistance induced by the generator on the drive wheel. For example, in a working embodiment, the battery comprises a 12 volt sealed lead acid battery requiring a 1.2 amp charging current and the drive wheel 22 has a diameter of about seven inches. The charging generator in this example may be a model CMB1D17NZ, manufactured by Leeson. In a conveyance traveling at about 400 feet/minute, the drive wheel rotates at about 200 rev/min. The transmission mechanism is selected to rotate the generator at a speed of about 1000 rev/min to provide at least a 1.2 amp charging current to the battery. In one example, this is accomplished with sprockets 34 and 44 comprising 39 teeth, 4.36 inch diameter sprockets, and sprockets 38 and 48 comprising 13 teeth, 1.74 inch diameter sprockets. The size of the drive wheel and/or the sprockets can be changed to produce the required charging current at different conveyance speeds.

Figure 2B:
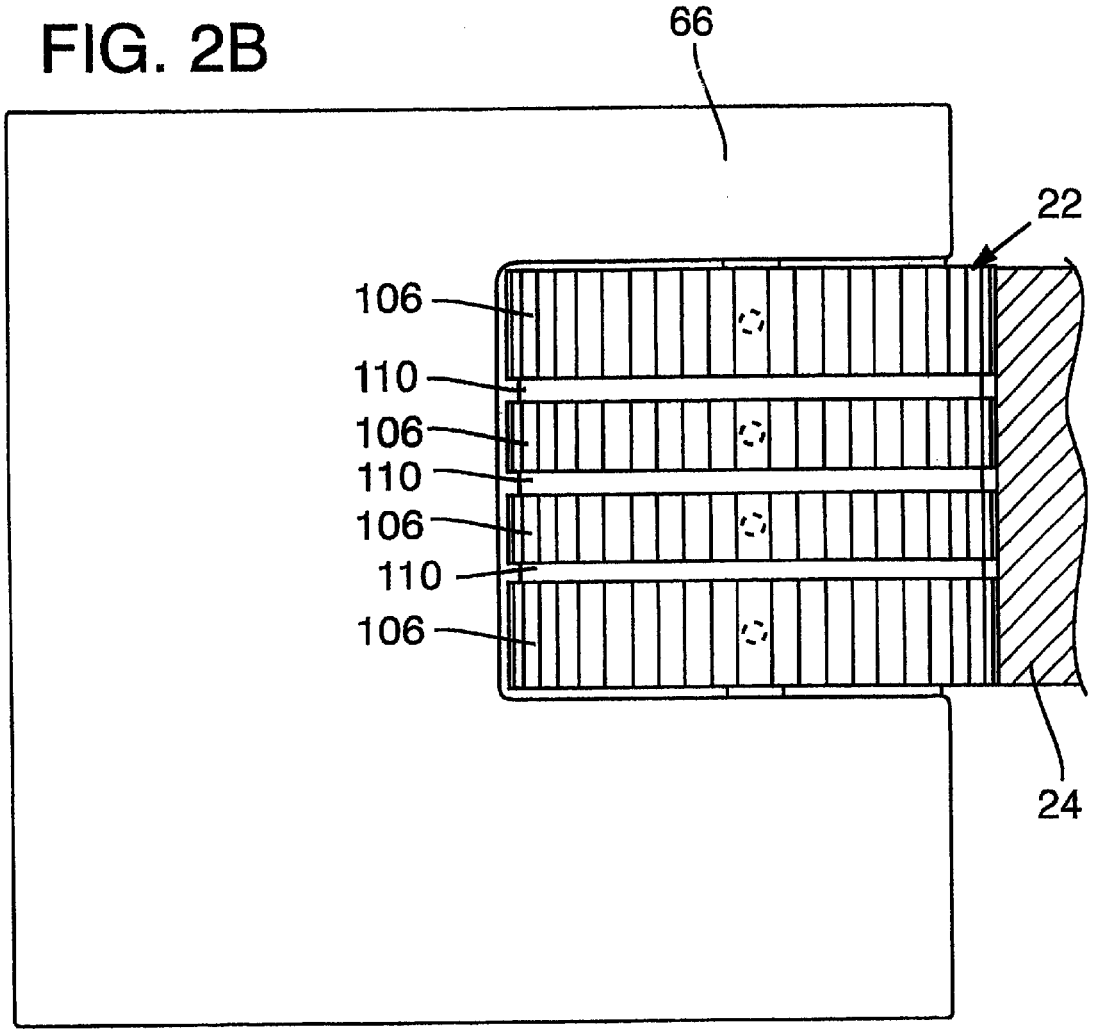
FIG. 2B is a top plan view of the apparatus of FIG. 2A showing a box cover covering the electrical and mechanical components of the apparatus.

Referring now to FIG. 2B, a removable, protective box cover 66 covers the generator, encoder, potentiometer, battery, charging circuit enclosure and the transmission mechanism. The cover 66 protects these components from the harsh mine environment. A cover hood also could be extended over the top of wheel 22 if desired.

As previously mentioned, a biasing mechanism resiliently urges, or biases, movable support 50 and drive wheel 22 mounted thereon toward shaft guide 24. In addition to longitudinal movement, support 50 may be mounted to allow for slight lateral movement (i.e., in a direction generally parallel to the central, or rotational, axis of the drive wheel) and for slight pivoting relative to the conveyance in a plane defined by the support.

Figure 3A:
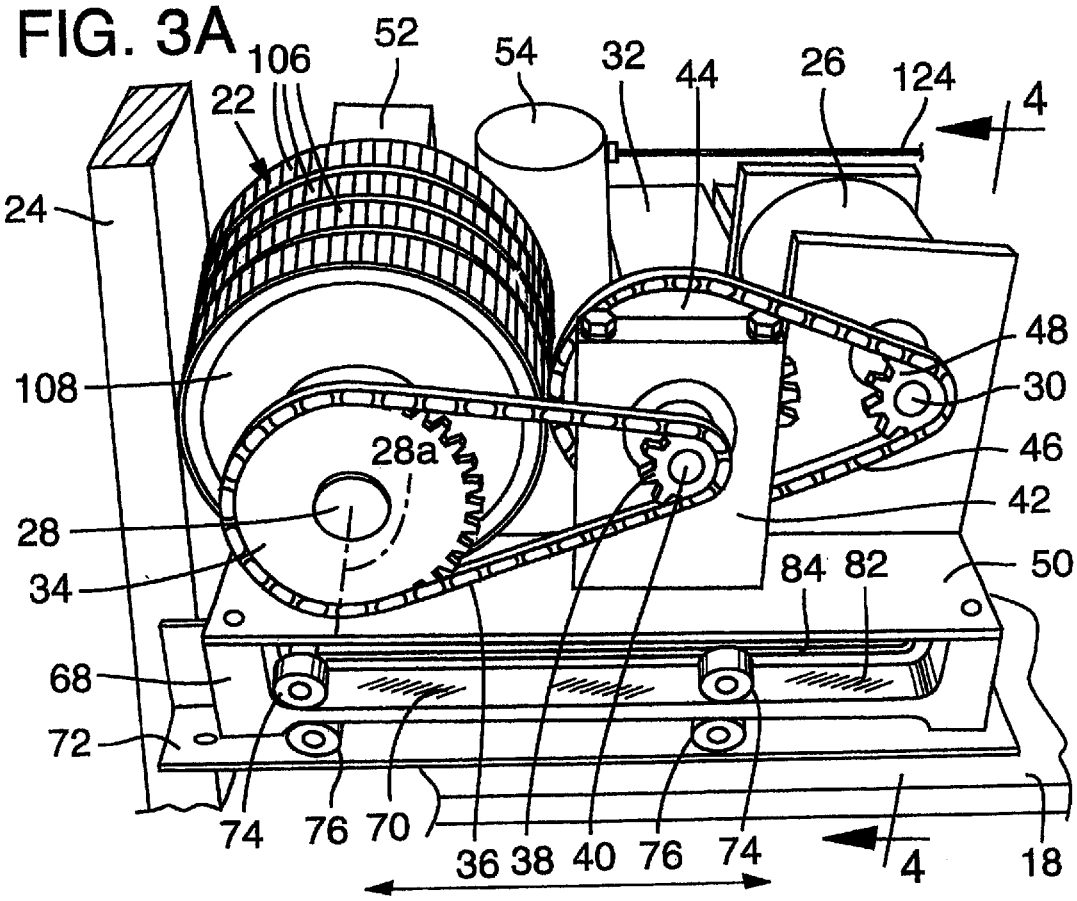
FIG. 3A is a side perspective view of the onboard power generation apparatus of FIG. 2A taken generally along line 3—3 in FIG. 2A.
Figure 3B:
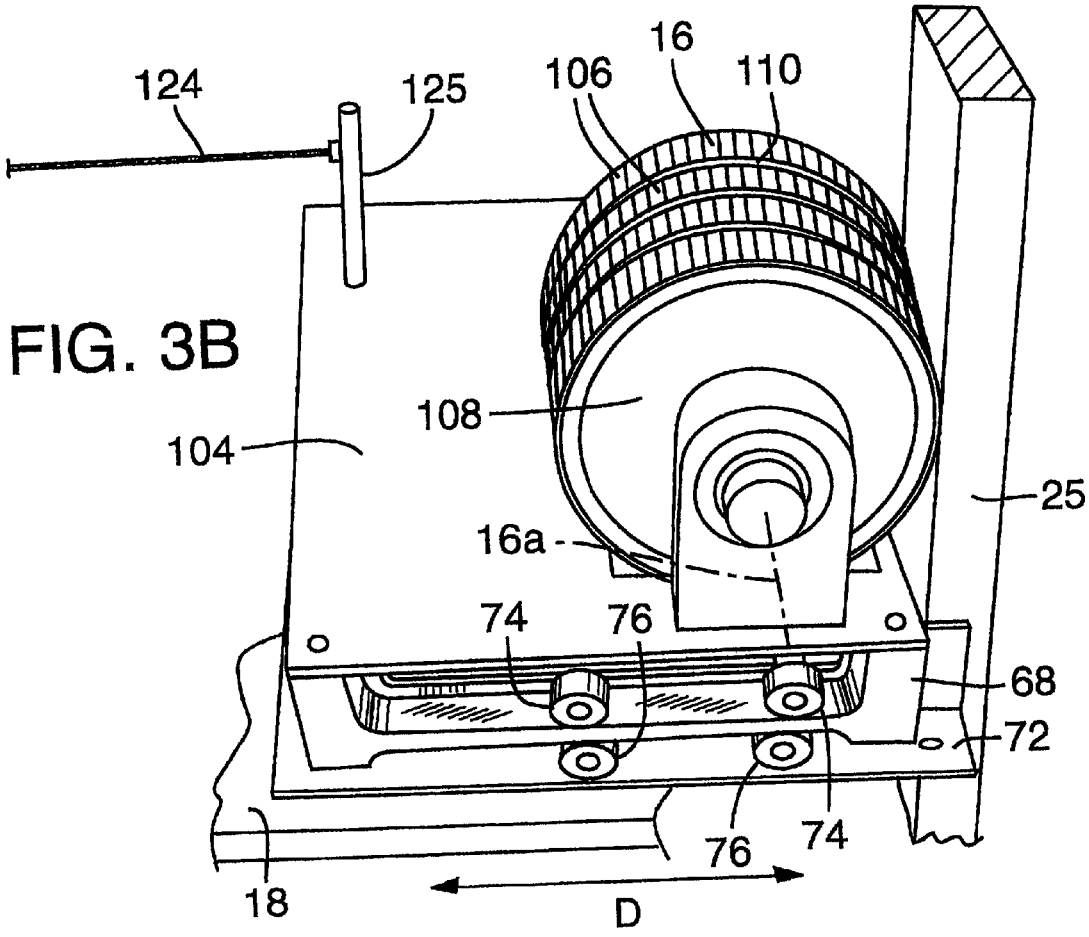
FIG. 3B is a side perspective view of a guide wheel mounted on a movable support at the opposite side of the conveyance.
Figure 4:
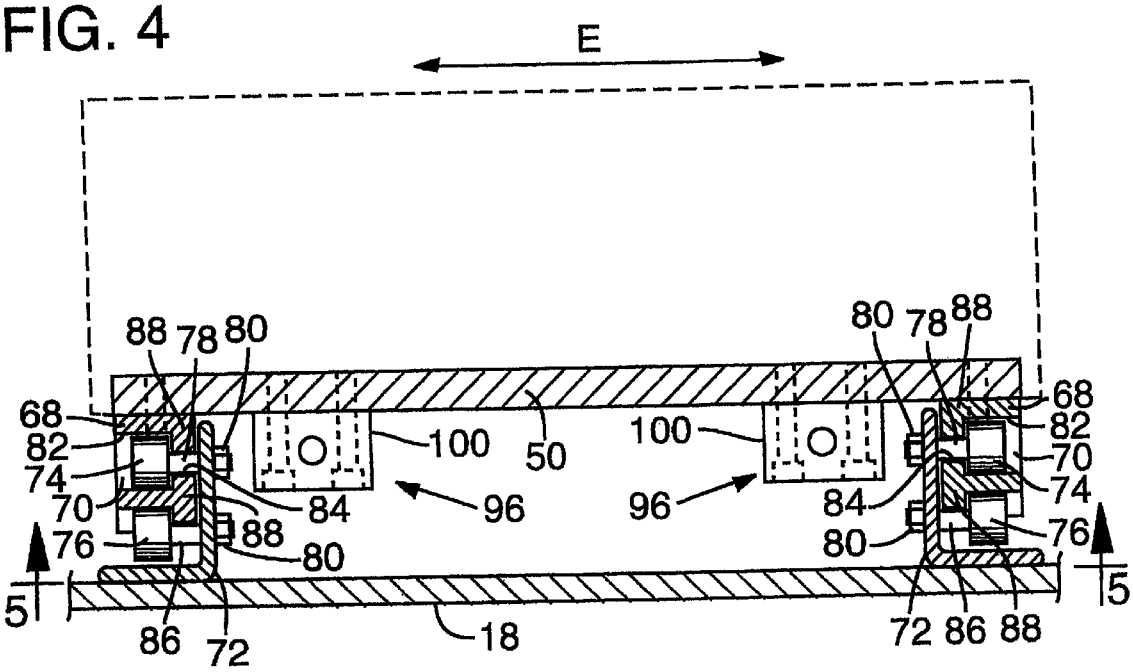
FIG. 4 is a cross-sectional view of the movable support for the power generation apparatus taken along line 4—4 of FIG. 3A.

In the illustrated embodiment, for example, a pair of laterally spaced, substantially parallel, guides, or rails, 68 are secured to the bottom of the support 50 (as best shown in FIGS. 3A, 4). Each rail 68 has a longitudinally extending slot, or channel, 70 having first and second portions 82 and 84. An elongate bracket 72 having an L-shaped angle cross-section is provided for mounting on platform 18 of conveyance 10 adjacent to each of rails 68. Secured to an upstanding leg of each bracket 72 is a pair of spaced apart upper rollers 74 positioned in the first portion 82 of the channel 70 and a pair of spaced apart lower rollers 76 positioned to engage the lower surface of each rail 68 (as best shown in FIGS. 3A, 4). A shaft 78 of each upper roller 74 extends through the second portion 84 of an adjacent channel 70 and a hole in its respective bracket 72. A nut 80 is secured on the end of each shaft 78 opposite its upper roller 74. Each lower roller 76 has a shaft 86 that extends through a hole in its respective bracket 72 and is secured with a nut 80 disposed on its outer end. The nut 80 of each shaft 78, 86 can be adjusted to adjust the spacing of its roller from the upstanding leg of a corresponding bracket 72.

The upper and lower rollers 74 and 76 permit longitudinal movement of the support 50 relative to the conveyance in a direction toward and away from the shaft guide 24 (i.e., perpendicular to rotational axis 28*a*) as indicated by double-headed arrow C in FIGS. 2A, 3A. Reversing the mounting of the brackets and rails would achieve the same effect. In other words, the brackets along with their upper and lower rollers could be secured to the support 50 and the rails could be secured to the conveyance 10 to permit such movement of the support.

As further shown in FIG. 4, the rollers are positioned so that there is a slight clearance between a vertical portion 88 of each rail and the upstanding leg of an adjacent bracket 72 and between the vertical portion 88 and adjacent upper and lower rollers 74, 76. This clearance is adjustable by selected positioning of nuts 80 on shafts 78, 86 and allows for slight lateral movement of the support 50 (as indicated by double-headed arrow E in FIG. 4) and for slight cocking or pivoting of the support relative to the conveyance in a plane defined by the support (as indicated by double-headed arrow B in FIG. 2A).

Figure 5:
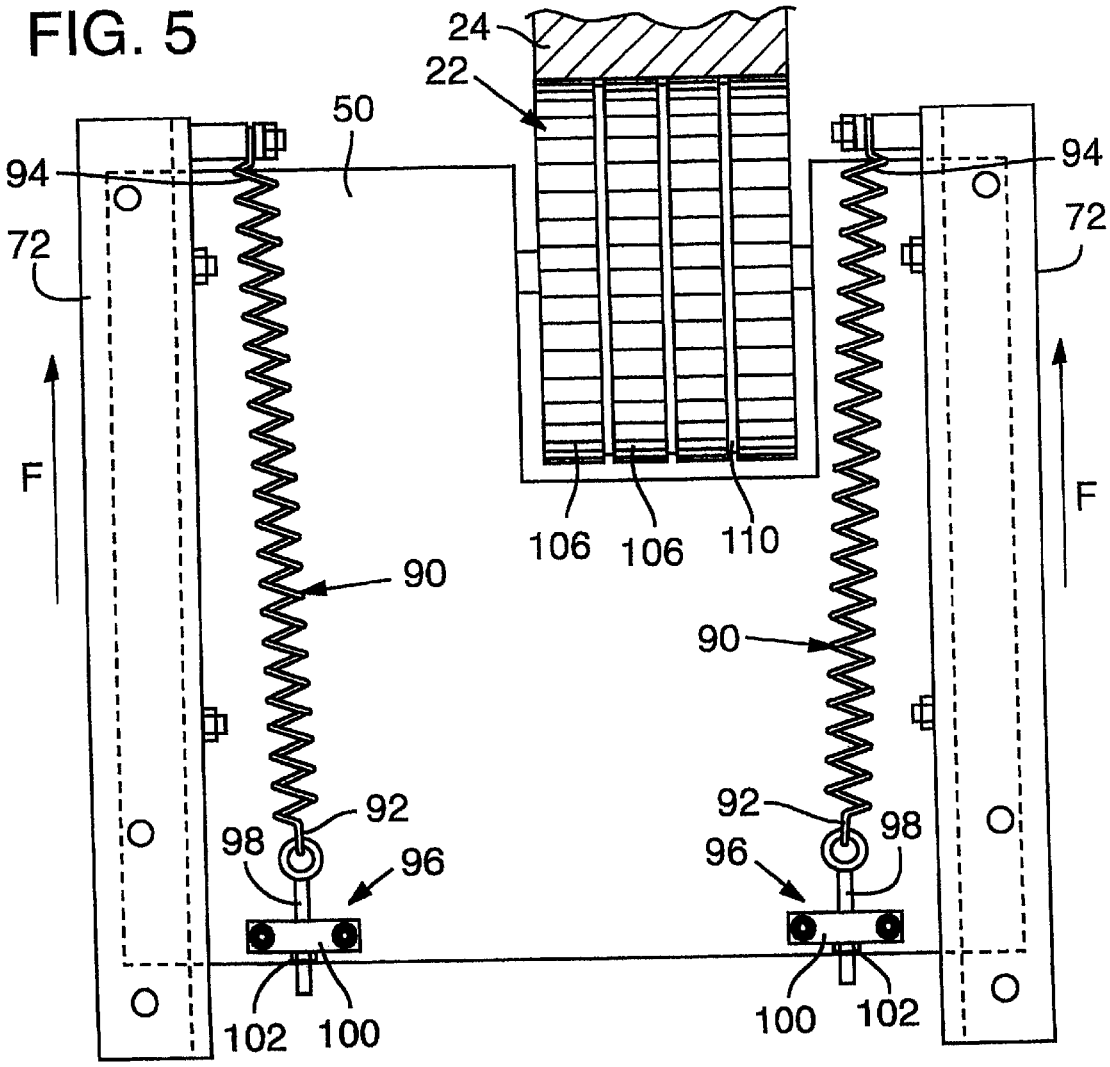
FIG. 5 is a bottom plan view of the onboard power generation apparatus taken generally along the line 5—5 in FIG. 4.

Referring to FIG. 5, a bottom view of the support 50 is shown. A pair of elongate springs 90 are interposed between the conveyance and the support 50. Each spring has spaced first and second ends 92 and 94. The first end 92 of each spring is secured to the bottom of the support 50 with a spring tensioner 96 disposed adjacent to what may be considered the inner, or rear, end of support 50. The second end 94 of each spring 90 is secured to a corresponding bracket 72 at what may be considered the outer, or forward end of the bracket 72. Thus, it can be seen that the springs 90 yieldably bias the support toward the shaft guide 24 to maintain contact between drive wheel 22 and shaft guide 24 (as indicated by arrows F).

In the illustrated example, each of the spring tensioners 96 comprises an eye bolt 98 for connecting to a spring 90. Each eye bolt 98 extends through a member 100 secured to the bottom of the support 50. An adjusting nut 102 is screwed onto the outer end of each eye bolt 98 for increasing or decreasing the length, and thereby the tension, of the corresponding spring 90. Desirably, spring tensioner 96 are adjusted to provide a biasing force sufficient to maintain rolling contact between drive wheel 22 and shaft guide 24 while minimizing wear of the drive wheel. If the drive wheel 22 is positioned closer to one spring than the other, such as for packaging purposes, the springs can be adjusted to provide uniform pressure across the surface of the drive wheel contacting the shaft guide 24. In the illustrated embodiment, for example, the drive wheel is positioned slightly closer to the spring on the right side of the support 50 than the spring on the left side of the support (as shown in FIG. 5). As such, the tensions of the springs may be adjusted to create uniform pressure on the drive wheel.

Although the illustrated form is shown as having a pair of springs, any number of springs may be used. In addition, other forms of biasing mechanisms may also be used. For example, elastomeric bands could be substituted for the springs.

As best shown in FIGS. 2A, 3A, the drive wheel 22 in the illustrated embodiment comprises an inner drum 108 and a plurality of elastomeric outer tread layers 106 to minimize slip between the drive wheel and a possibly muddy and wet shaft guide 24. The tread layers 106 are desirably spaced apart along the longitudinal axis of the drive wheel 22 so as to define water channels 110 in the spaces between adjacent tread layers 106 (as best shown in FIG. 2A). In a working embodiment, the tread layer 106 comprises two-ply, red carboxilated nitrile rubber, manufactured by Goodyear Tire and Rubber. Each tread layer 106 is secured the inner drum 108 in a suitable manner, such as with rivets 112. In an alternative embodiment, the drive wheel 22 may comprise a single tread layer with or without water channels. Still alternatively, the drive wheel may comprise plural, longitudinally spaced shaft guide engaging portions with water channels therebetween, but without any tread layers.

In an another alternative configuration, the drive wheel 22 may comprise one or more conventional guide wheels (e.g., three guide wheels in a working embodiment) mounted on a common shaft. The guide wheels desirably are longitudinally spaced from each other along the shaft so as to define water channels between adjacent guide wheels. Spacers may be mounted on the shaft between adjacent guide wheels so as to define the width of the water channels.

Referring to FIG. 3B, the support 104 for guide wheel 16 is mounted to the conveyance generally in the same manner as the support 50 for the drive wheel 22. In addition, as described above in connection with the support 50, a pair of springs may be interposed between the conveyance and the support 104 to bias the guide wheel 16 against the shaft guide 25. Additionally, the guide wheel 16, like the drive wheel 22, may comprise plural, spaced-apart tread layers 106 secured to an inner drum 108 so as to define water channels 110.

Apparatus 20 is packaged in a lightweight, compact package. In a working embodiment, the footprint of support 50 is ten inches by ten inches. The overall height of apparatus 20 with box cover 66 installed is four inches (excluding height of drive wheel 22).

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

We claim:

1. Onboard power generation apparatus for a hoist conveyance comprising:

a drive wheel carried by the conveyance and positioned to engage the surface of a stationary structure adjacent the conveyance so that movement of the conveyance relative to the structure causes rotation of the drive wheel; and a charging generator coupled to the drive wheel, the generator operable to produce an electric current upon rotation of the drive wheel.

2. The apparatus of claim 1 further comprising a battery electrically connected to the generator wherein the generator provides an electric current to recharge the battery.

3. The apparatus of claim 1 further comprising biasing mechanism for yieldably biasing the drive wheel toward the surface of the adjacent structure.

4. The apparatus of claim 1 wherein the drive wheel has an output shaft and the charging generator has an input shaft operatively coupled to the output shaft of the drive wheel so that rotation of the drive wheel causes rotation of the input shaft of the charging generator.

5. The apparatus of claim 1 wherein an encoder is coupled to the shaft of the drive wheel.

6. The apparatus of claim 1 wherein the drive wheel comprises an elastomeric tread layer to minimize slip between the drive wheel and the surface of the adjacent structure.

7. The apparatus of claim 1 wherein the drive wheel and charging generator are mounted on a common support and the support is mounted for movement relative to the conveyance in a direction generally perpendicular to the surface of the adjacent structure; and at least one spring is interposed between the support and the conveyance to bias the support toward the adjacent structure to maintain contact between the drive wheel and the surface of the structure.

8. The apparatus of claim 1 wherein the drive wheel is carried by a support and the support is mounted for pivoting in a plane defined by the support.

9. The apparatus of claim 1 wherein the drive wheel has a central axis and is mounted on a support, and the support is mounted for movement relative to the conveyance in a direction generally perpendicular to the central axis of the wheel and in a direction generally parallel to the central axis of the drive wheel.

10. The apparatus of claim 1 wherein the drive wheel is mounted on a support;

a pair of laterally spaced, substantially parallel rails are secured to the bottom of the support; and a pair of laterally spaced, substantially parallel brackets are mounted to the conveyance with each bracket being adjacent to one of said rails, each bracket having a set of rollers positioned to engage one of said rails to permit movement of the support relative to the conveyance.

11. The apparatus of claim 10 wherein each rail has a longitudinally extending slot and each bracket has at least two spaced-apart rollers disposed in the slot of a respective rail.

12. The apparatus of claim 11 wherein each bracket has at least two spaced-apart rollers positioned to engage the bottom of a respective rail.

13. Onboard power generation apparatus for supplying power to a vertically movable hoist conveyance comprising:

a generator assembly comprising at least one drive wheel rotatably coupled thereto and operable to contact the surface of an adjacent stationary structure so that movement of the conveyance causes rotation of the drive wheel to generate an electric current; and a support on which the drive wheel is mounted, the support being movable with respect to the conveyance to accommodate variations in the surface of the adjacent structure as the conveyance moves vertically relative to the structure.

14. The apparatus of claim 13 wherein one of said support or conveyance has a pair of rails secured thereto and the other of said support or conveyance has a plurality of rollers connected thereto positioned to engage said rails and permit movement of the support relative to the conveyance.

15. The apparatus of claim 14 further comprising at least two spaced apart brackets for mounting to the conveyance with each bracket being adjacent to one of said rails, each bracket having at least two spaced-apart rollers for movably engaging a respective rail.

16. The apparatus of claim 15 wherein each rail comprises a longitudinally extending slot for receiving the rollers of a respective bracket.

17. The apparatus of claim 13 further comprising at least one spring for urging the support toward the surface of the adjacent structure.

18. The apparatus of claim 13 wherein the generator is operatively connected to an onboard battery for recharging the battery.

19. Onboard power generation apparatus for a mine hoist conveyance having guide wheels for engaging shaft guides and onboard instrumentation for monitoring the operation of the conveyance, the apparatus comprising:

a battery for supplying power to instrumentation of the conveyance; and a generator carried by the conveyance and operatively connected to a guide wheel of the conveyance to produce an electric current upon movement of the conveyance and electrically connected to the battery to recharge the battery.

20. The apparatus of claim 19 wherein the guide wheel operatively connected to the generator comprises plural shaft guide engaging portions that are spaced apart in a direction parallel to the central axis of the guide wheel so as to define a water channel in the space between adjacent shaft guide engaging portions.

21. The apparatus of claim 19 wherein the guide wheel operatively connected to the generator has an outer elastomeric tread layer to minimize slip between the guide wheel and a respective shaft guide.

22. The apparatus of claim 19 wherein the generator produces a charging current to the battery of about 1.2 amps.

23. The apparatus of claim 19 wherein the guide wheel operatively connected to the generator comprises an output drive sprocket and the generator comprises a driven sprocket connected to the drive sprocket through a drive chain assembly.

24. The apparatus of claim 23 wherein the gear ratio of the drive sprocket to the driven sprocket is selected so that the vertical speed of the conveyance causes rotation of the generator at a rotational speed that is sufficient to maintain an adequate charging current to the battery.

25. Onboard power generation apparatus for a hoist conveyance comprising:

rotatable engaging means for engaging the surface of a substantially stationary structure adjacent to the conveyance such that movement of the conveyance causes rotation of the engaging means; and generating means operatively connected to said engaging means for generating an electric current to provide power to the conveyance upon rotation of the engaging means.

26. The apparatus of claim 25 wherein the engaging means comprises a guide wheel of a mine shaft hoist conveyance.

27. The apparatus of claim 25 wherein the stationary structure comprises an elevator shaft guide.

28. The apparatus of claim 25 further comprising biasing means for biasing the engaging means against the surface of the adjacent structure.

29. The apparatus of claim 25 wherein the engaging means comprises a wheel having plural, axially spaced tread layers with water channels defined therebetween.

30. The apparatus of claim 25 wherein a conveyance monitoring device is connected to the conveyance and the generating means provides power for said monitoring device.

31. The apparatus of claim 25 wherein the generating means is connected to a battery through a charging circuit to permit charging of the battery upon vertical movement of the conveyance.

32. A method for generating power for a hoist conveyance operable to move in a vertical direction through a shaft, the method comprising:

providing a generator assembly for mounting on the conveyance, the generator having at least one wheel for contacting a substantially stationary surface of the shaft; and generating an electric current when the wheel rotates upon movement of the conveyance.

33. The method of claim 32 further comprising recharging a battery onboard the conveyance with the electric current.

34. The method of claim 33 wherein the battery provides power to at least one instrumentation device onboard the conveyance.

35. The method of claim 32 further comprising resiliently urging the wheel of the generator assembly laterally of its central axis toward the surface of the shaft to accommodate variations in the surface as the conveyance is moved.

36. Onboard power generation apparatus for supplying power to a vertically movable hoist conveyance comprising:

first and second, opposing guide wheels, each guide wheel being mounted on a movable support, each support being mounted for movement relative to the conveyance in a direction generally perpendicular to an adjacent shaft guide;

a biasing mechanism for yieldably biasing each guide wheel against an adjacent shaft guide so that vertical movement of the conveyance causes rotation of the wheels; and a charging generator coupled to one of said guide wheels, the generator operable to produce an electric current upon rotation of said guide wheel.

37. The apparatus of claim 36 further comprising sensing mechanism interposed between the guide wheels to monitor lateral displacement between the guide wheels and thereby the lateral displacement of the shaft guides.

38. The apparatus of claim 37 wherein the sensing mechanism comprises a potentiometer having a retractable string, the potentiometer is carried by one of said supports, and the free end of the string is coupled to the other of said supports.

* * * * *